United States Patent [19]

Westhoff et al.

[11] 4,305,759

[45] Dec. 15, 1981

[54] APPARATUS AND METHOD FOR WASHING ROTOR CHAMBERS

[75] Inventors: James R. Westhoff; Robert C. Bartsch, both of Phoenix, Ariz.

[73] Assignee: Southwest Veterinary Diagnostics, Inc., Phoeniz, Ariz.

[21] Appl. No.: 135,142

[22] Filed: Mar. 28, 1980

[51] Int. Cl.[3] ..... B08B 9/00

[52] U.S. Cl. ..... 134/22 R; 134/26; 134/57 R; 134/114; 134/166 R; 134/169 R; 134/171

[58] Field of Search ..... 134/10, 22 R, 24, 26, 134/30, 57 R, 114, 166 R, 169 R, 171, 201

[56] References Cited

U.S. PATENT DOCUMENTS 2,788,008 4/1957 Wanzer ..... 134/171 X 3,534,749 10/1970 Till ..... 134/171 X

*Primary Examiner*—Marc L. Caroff

*Attorney, Agent, or Firm*—Cahill, Sutton & Thomas

[57] ABSTRACT

A washing head, having two annular compartments, includes a plurality of ported posts in fluid communication with one of the annular compartments; each of the posts being respectively aligned with a first aperture in one of a plurality of radially oriented dual apertured chambers of a rotor to inject a washing fluid into each of the chambers. Each of the second apertures in each of the plurality of chambers is in fluid communication with and discharges the washing fluid to the other of the annular compartments.

14 Claims, 5 Drawing Figures

APPARATUS AND METHOD FOR WASHING ROTOR CHAMBERS

The present invention relates to washing apparatus and, more particularly, to washing apparatus for devices having multiple radially oriented chambers.

Washing or cleaning devices of various types and operating in conformance with one or more of a multitude of cleaning cycles are well known. These washing devices include both closed loop and open loop systems, depending to a great extent upon the nature of the article being washed, the nature of the washing fluid being used and environmental considerations.

For various diagnostic and testing purposes, rotors having a plurality of radially oriented chambers are used wherein the fluid to be tested is disposed into each of the chambers and particular tests, usually in conjunction with centrifuging, are conducted upon the fluid in each of the chambers. These chambers often include two apertures, one for filling the chamber and the second for overflow, insertion of test elements, etc. Because of the elongated small cross-section configuration of the chambers, cleaning by known methods is not cost effective. Accordingly, the rotors are essentially a one time use item and disposed of on completion of the test. These rotors are relatively expensive and disposal thereof represents an added expense to the cost of testing.

It is therefore a primary object of the present invention to provide apparatus for washing radially oriented chambers within a rotor.

Another object of the present invention is to provide a stream of washing fluid flowing through each chamber of a plurality of radially oriented chambers.

Yet another object of the present invention is to provide apparatus for scouring each of a plurality of elongated radially oriented chambers by inducing turbulent fluid flow therethrough.

Yet another object of the present invention is to provide washing apparatus for injecting a stream of washing fluid through each of a plurality of elongated radially oriented chambers for a specified time duration.

A further object of the present invention is to provide a washing apparatus for serially injecting streams of different fluids through elongated radially oriented chambers.

A yet further object of the present invention is to provide washing apparatus for a microcentrifugal analyzer.

A still further object of the present invention is to provide apparatus for washing inexpensively microcentrifugal analyzers.

These and other objects of the present invention will become apparent to those skilled in the art as the description thereof proceeds.

The present invention may be described with specificity and clarity with reference to the following drawings, in which:

FIG. 1 is an isometric view of the washing apparatus;

FIG. 2 illusrates a part of the plumbing system for the washing apparatus;

Figure 1:
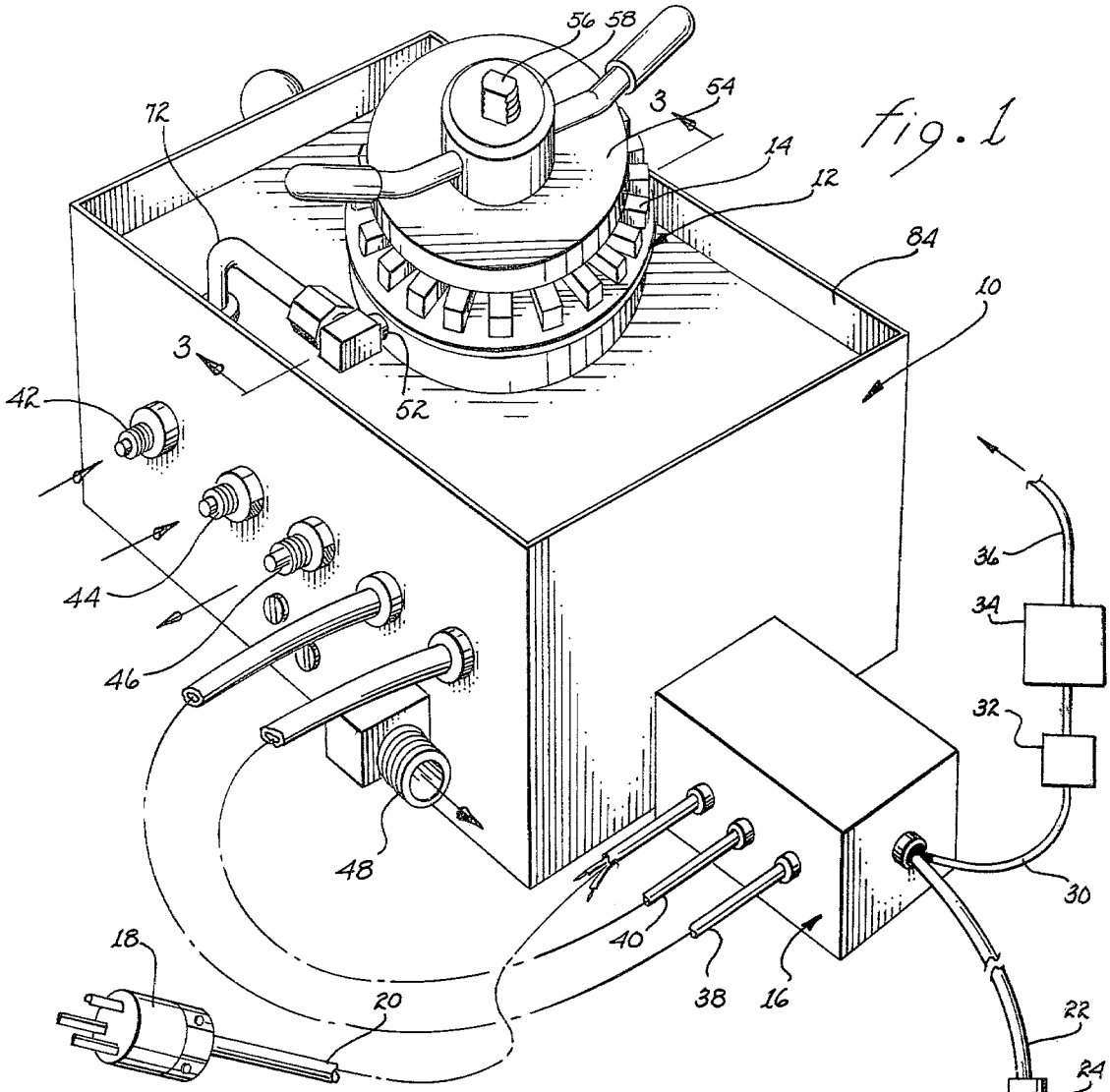

Referring to FIG. 1, there is shown a washing unit 10 having a washing head 12 mounted thereon and supporting a rotor 14. The rotor illustrated in this and the other figures is known as a "multi-stat III microcentrifugal analyzer" manufactured and sold by Instrumentation Laboratories, Inc.

A control unit 16 provides control signals and a source of electrical power for various fluid flow switching and timing cycles. Power to the control unit is provided through a conventional plug 18 and electrical conductor 20. The control unit transmits electrical power through conductor 22 and plug 24 to an electrically operated pump 26. The pump pumps a washing fluid, nominally a liquid or any cleaning solution, through conduit 28. Conduit 28 is connected to input nipple 42 to convey the liquid to the washing unit. Electrical power, on command, may also be transmitted through conductor 30 and plug 32 to gas pump 34, which pump may be an air pump. The air pump pumps air through conduit 36. Conduit 36 is connected to input nipple 44 to convey a flow of air to the washing unit. Electrical signals from control unit 16 to washing unit 10 to operate various valves are transmitted via electrical conductors 38 and 40. A discharge hose, not shown, is connected to nipple 46 for conveying liquid discharged from the washing unit. A further discharge outlet 48 is employed to discharge liquid spillage into a hose (not shown).

Washing head 12 includes a base member 50 for supporting rotor 14 and directing washing liquid into and out of the rotor. A pressure plate 54 is penetrably mounted upon threaded stud 56 and rests upon rotor 14. The plate is cinched against the rotor to lock it in place upon base member 50 by a locking element 58.

Figure 2:
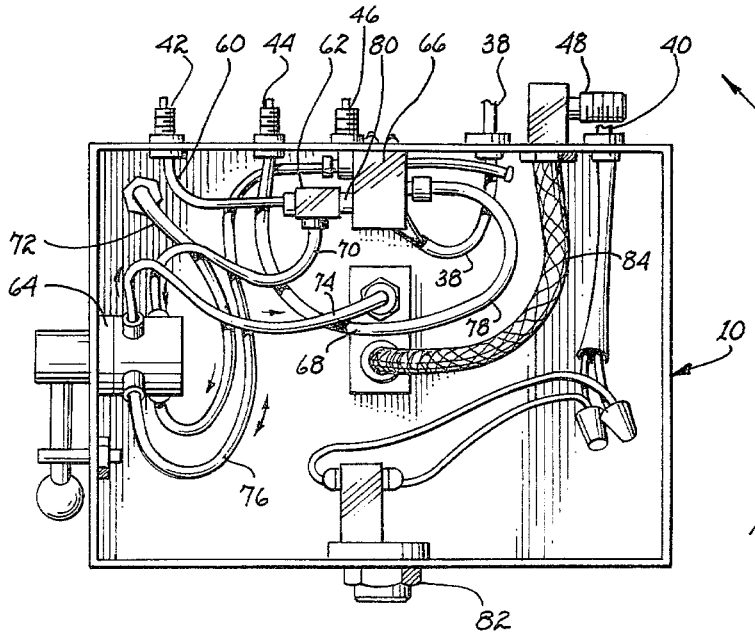

The plumbing system within washing unit 10 will be described with joint reference to FIGS. 1 and 2. An inflow of washing liquid from conduit 28 is introduced to nipple 42 and conveyed through conduit 60 to a tee 62; from the tee, the washing liquid is conveyed through conduit 70 to reversing valve 64 and through conduit 80 to electrically actuated selected unit 66. When air pump 34 is energized, a flow of air is conveyed by conduit 36 to nipple 44 and through conduit 68 to the selector unit. Pursuant to an electrical control signal transmitted through electrical conductor 38 from control unit 16, the selector unit is energized to block the flow of either air (gas) or the washing liquid. Assuming that the medium selected is the washing liquid, it will flow from tee 62 through conduit 70 to reversing the valve 64. From the reversing valve, the liquid flows through conduit 74 and into washing head 12 through inlet pipe 94. After the washing liquid has flowed through rotor 14, it is collected and flows back to reversing valve 64 through conduit 72. From the reversing valve, the fluid flows through conduit 76 to nipple 46 and is discharged therefrom into a conduit and suitable container or collection unit. Upon actuation of reversing valve 64, the fluid flow through conduits 72 and 74 is reversed whereby flow in the opposite direction through rotor 14 is achieved.

When a gas is to be passed through rotor 14, air pump 34 is energized by control unit 16 to pump air through conduit 36 into washing unit 10 through nipple 44. The gas is conveyed from nipple 44 to selector unit 66 through conduit 68. Simultaneous with energization of air pump 34, pump 26 is deenergized. Moreover, selector unit 66 is energized by a control signal transmitted through an electrical conductor 38. From the selector unit, the gas flows through conduit 80 into tee 62. Flow of the gas through conduit 60 and out through nipple 42 is precluded by blockage effected by pump 26. Accordingly, the gas flows through conduit 70 to reversing valve 64, to washing head 12 through conduit 74, is returned to the reversing valve through conduit 72 and finally conveyed to nipple 46 through conduit 76. Actuation of reversing valve 64 will provide a flow through the washing head in the reverse direction, as described above.

A main switch 82 is mounted upon washing unit 10. On actuation of the switch, the circuit represented by electrical conductor 40 is completed and control unit 16 is energized to initiate a predetermined washing cycle. This cycle regulates both the flow duration as well as the type of medium (liquid or gas) to be used in the washing process.

Washing unit 10 includes a trough 84 disposed in the top thereof and surrounding washing head 12. This trough collects any spilled washing liquid, which spillage may result during removal of rotor 14 or as a result of leakage of any seals within the washing head. The trough channels any collected fluid into conduit 84 and through outlet 48. The outlet may be connected to a hose or similar means for ultimate discharge of the collected fluid.

Referring jointly to FIGS, 1, 3 and 4, the structure and operation of washing head 12 will be described. Base member 50 includes a pair of annular compartments 90 and 92 separated by an annular wall 91. Compartment 90 is in fluid communication with conduit 74 through pipe 94 and receives the washing liquid flowing through conduit 74. Compartment 92 is in fluid communication with outlet 52. A plate 96 is disposed upon and attached to base 50 by a plurality of counter sunk bolts 98 disposed in the perimeter of the plate. A threaded stud 56 is secured to the center of base 50 and extends upwardly therefrom into penetrable sealed engagement with plate 96. A plurality of hollow ported posts 98 extend through and upwardly from plate 96. Each of these posts includes a port or nozzle 100 for directing fluid flow therethrough lateral to the post. These posts are arranged in a circular pattern around stud 56 and equiangularly displaced with respect to one another commensurate with the chambers in rotor 14.

Figure 4:
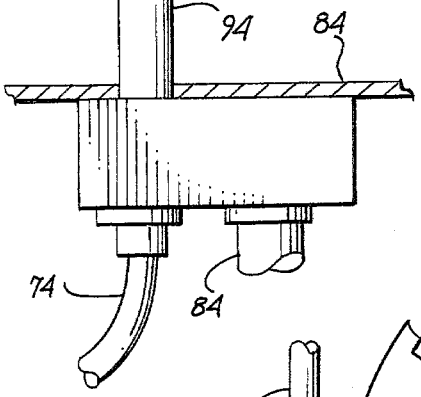
FIG. 4 is a multi-elevational view of a rotor mounted upon the washing head.
Figure 4:
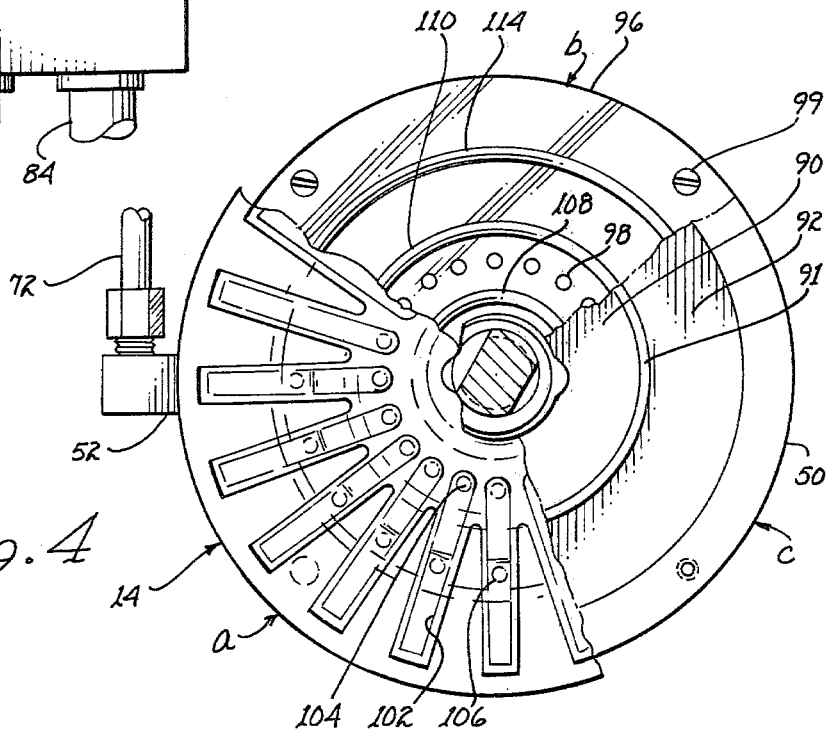

Rotor 14 (note in particular FIG. 4*a*) includes a plurality of radially oriented chambers 102. Each of these chambers includes an inlet aperture 104 at the radially inward end of the chamber and an outlet aperture 106 approximately mid point of the chamber. Each of posts 98 is positionally mounted upon plate 96 to coincide with and penetrate through one of inlet aperture 104 to direct any fluid discharged through nozzle 100 into chamber 102. Concentric O-rings or seals 108 and 110 are disposed in plate 96 to establish an annular sealed compartment intermediate rotor 14 and the plate on either side of the plurality of posts 98. Thereby, a seal intermediate posts 98 and apertures 104 in the chambers is unnecessary. Each of a plurality of apertures 112 is disposed in plate 98 coincident with annular compartment 92 and one of apertures 106 of rotor 14. The washing liquid (or gas) discharged into each of cavities 102 is discharged therefrom through apertures 106, apertures 112 and into annular compartment 92. The discharged washing liquid (or gas) flows through outlet 52 and into conduit 72, as described above. A further O-ring or seal is disposed in plate 96 intermediate the plate and rotor 14 concentric with and lateral to apertures 112. Thereby, a sealed annular compartment is established intermediate seals 110, 114, plate 96 and rotor 14 coincident with apertures 106 and 112 to preclude leakage.

Figure 3:
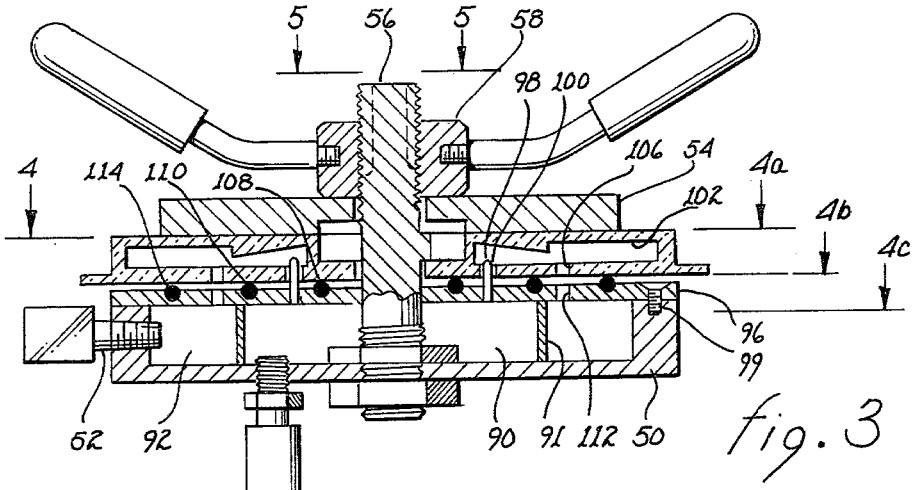
FIG. 3 is a partial cross-sectional view of the washing head.
Figure 5:
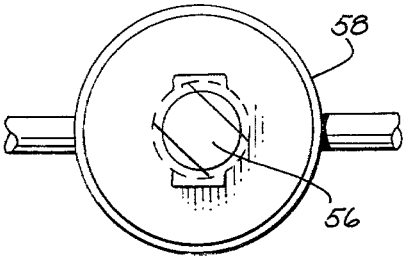
FIG. 5 illustrates apparatus for locking the rotor upon the washing head.

Rotor 14 is maintained adjacent plate 96 in a sealed relationship by plate 54 penetrably engaging stud 56 and cinched down by locking element 58, as shown in FIGS. 1, 3 and 5. The locking element may be of the quick release type well known in the art. Thereby, the rotors are quickly and easily placed upon and removed from washing head 12.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. Washing apparatus for washing a rotor having radially oriented chambers, each chamber including a first aperture and a second aperture radially outwardly displaced from the first aperture, said apparatus comprising in combination:

(a) a washing head, said washing head comprising:
  i. a base member including a first and second annular compartment;
  ii. a plurality of ported posts, each of said posts being in fluid communication with one of the first apertures in each of the chambers and said first compartment for conveying a washing fluid into each chamber from said first compartment;
  iii. a plurality of apertures, each of said apertures being in fluid communication with one of the second apertures in each of the chambers and said second compartment for directing the washing fluid discharged from each chamber into said second compartment; and
  iv. means for detachably attaching the rotor to said base member;

(b) a washing unit for conveying the washing fluid to and from said washing head, said washing unit including:
  i. first means for conveying the washing fluid to said first compartment; and
  ii. second means for conveying the washing fluid from said second compartment;

(c) a source of washing fluid and means for regulating the flow of washing fluid from said source to said washing unit; and (d) a control unit for actuating said regulating means for a predetermined duration.

2. The apparatus as set forth in claim 1 wherein said washing unit includes means for reversing the flow path of the washing fluid through said washing head.

3. The apparatus as set forth in claim 1 wherein said source includes a source of washing liquid and a source of washing gas and said control unit includes means for controling the type and direction of flow of washing fluid.

4. The apparatus as set forth in claim 1 wherein said washing unit includes a trough for collecting any spillage of washing fluid.

5. A method for washing simultaneously each of a plurality of radially oriented dual apertured chambers disposed in a rotor, said method comprising the steps of:

(a) establishing a source of washing fluid under pressure;

(b) conveying the washing fluid to a first compartment;

(c) channeling each of a plurality of individual streams of the washing fluid from the first compartment to one of a plurality of first locations, each of said first locations being disposed on a discrete radial coinciding with a radial defined by a respective one of the radially oriented chambers and in fluid communication with the respective one of the radially oriented chambers;

(d) injecting an individual stream of washing fluid from each of the first locations respectively into one aperture in each of the radially oriented chambers from the first compartment;

(e) receiving all the discharge of the washing fluid from the other aperture of the respective one of the radially oriented chambers at one of a plurality of second locations, each of said second locations being radially displaced from a respective first location and in fluid communication with the respective one of the radially oriented chambers;

(f) collecting the washing fluid discharged from the other aperture in each of the chambers in a second compartment;

(g) disbursing the washing fluid from the second compartment; and (h) regulating the duration of injection of the washing fluid into the chambers.

6. The method as set forth in claim 5 including the step of injecting first one washing fluid and then another washing fluid into each of the chambers.

7. A method for washing simultaneously each of a plurality of radially oriented dual apertured chambers disposed in a rotor, said method comprising the steps of:

(a) establishing a source of washing fluid under pressure;

(b) conveying the washing fluid to a first compartment;

(c) injecting the washing fluid into one aperture in each of the chambers from the first compartment;

(d) collecting the washing fluid flowing from the other aperture in each of the chambers in a second compartment;

(e) disbursing the washing fluid from the second compartment;

(f) regulating the duration of injection of the washing fluid into the chambers; and (g) reversing the flow path of the washing fluid through the chambers.

8. A washing apparatus for a rotor having a plurality of dual apertured radially oriented chambers, said apparatus comprising in combination:

(a) a source of washing fluid under pressure;

(b) a first compartment;

(c) means for conveying the washing fluid from said source to said first compartment;

(d) a plurality of means for injecting the washing fluid from said first compartment respectively into each of the chambers through the first aperture in each chamber, each said injecting means being disposed on a discrete radial coinciding with a radial defined by the respective one of the radially oriented chambers;

(e) a plurality of means for respectively channeling the washing fluid flowing through each of the chambers and exhausting through the second aperture in each chamber, each said channeling means being radially displaced from the respective first aperture and on a radial coinciding with a radial defined by the respective one of the radially oriented chambers;

(f) a second compartment in fluid communication with said channeling means for collecting the washing fluid exhausted from the chambers; and (g) means for discharging the washing fluid from said second compartment.

9. The apparatus as set forth in claim 8 wherein said injecting means comprises a plurality of ported posts.

10. The apparatus as set forth in claim 9 wherein each of said posts extends into one of the chambers through one of the first apertures.

11. The apparatus as set forth in claim 10 wherein each of said posts includes a nozzle for discharging the fluid into one of the chambers.

12. The apparatus as set forth in claim 9 wherein said posts are annularly arranged about the center of the rotor to mate with the radially oriented chambers of the rotor.

13. The apparatus as set forth in claim 12 wherein said channeling means comprises a member having a plurality of holes disposed therein, each hole being coincident with another of the apertures in each of the chambers.

14. A washing apparatus for a rotor having a plurality of dual apertured radially oriented chambers, said apparatus comprising in combination:

(a) a source of washing fluid under pressure;

(b) a first compartment;

(c) means for conveying the washing fluid from said source to said first compartment;

(d) a plurality of ported posts annularly arranged about the center of the rotor to mate with the radially oriented chambers of the rotor for injecting the washing fluid from said first compartment into each of the chambers through one of the apertures in each chamber;

(e) a member having a plurality of holes disposed therein, each hole being coincident with another of the apertures in each of the chambers for channeling the washing fluid flowing through each of the chambers and exhausting through the other of the apertures in each chamber;

(f) means for sealing said ported posts and said member to preclude fluid communication therebetween other than through the respective ones of the chambers;

(g) a second compartment in fluid communication with said channeling means for collecting the washing fluid exhausted from the chambers; and (h) means for discharging the washing fluid from said second compartment.

* * * * *